US006269786B1

(12) United States Patent
Snyder et al.

(10) Patent No.: US 6,269,786 B1
(45) Date of Patent: Aug. 7, 2001

(54) COMPRESSION RELEASE MECHANISM

(75) Inventors: Dale D. Snyder, Neenah; Scot A. Koehler, Appleton; Randall E. Sterr, North Fond Du Lac; William M. Miller, Plymouth, all of WI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 09/358,012

(22) Filed: Jul. 21, 1999

(51) Int. Cl.[7] ..... F01L 13/08
(52) U.S. Cl. ..... 123/182.1
(58) Field of Search ..... 123/182.1

(56) References Cited

U.S. PATENT DOCUMENTS

| | | | |
|---|---|---|---|
| 868,765 | 10/1907 | Dock | 123/182.1 |
| 1,439,798 | 12/1922 | Crane | 123/182.1 |
| 1,990,427 | 2/1935 | Dawson | 123/182.1 |
| 2,054,928 | 9/1936 | Church | 123/182.1 |
| 2,086,609 | 7/1937 | Edwards | 123/182.1 |
| 2,947,300 | 8/1960 | Trapp | 123/182.1 |
| 3,314,408 | 4/1967 | Fenton | 123/182.1 |
| 3,362,390 | 1/1968 | Esty | 123/182.1 |
| 3,381,676 | 5/1968 | Campen | 123/182.1 |
| 3,496,922 | 2/1970 | Campen | 123/182.1 |
| 3,511,219 | 5/1970 | Esty | 123/182.1 |
| 3,620,203 | 11/1971 | Harkness | 123/182.1 |
| 3,897,768 | 8/1975 | Thiel | 123/182.1 |
| 4,590,905 | 5/1986 | Matsuki et al. | 123/321 |
| 4,615,313 | 10/1986 | Tsumiyama | 123/182.1 |
| 4,696,266 | 9/1987 | Harada | 123/182.1 |
| 4,892,068 | 1/1990 | Coughlin | 123/182.1 |
| 4,898,133 | 2/1990 | Bader | 123/182.1 |
| 5,065,720 | 11/1991 | Nishiyama et al. | 123/363 |
| 5,085,184 | 2/1992 | Yamada et al. | 123/182.1 |
| 5,197,422 | 3/1993 | Oleksy et al. | 123/182.1 |
| 5,317,999 | 6/1994 | Kern et al. | 123/182.1 |
| 5,402,759 | 4/1995 | Ding et al. | 123/182.1 |
| 5,809,958 | 9/1998 | Gracyalny | 123/182.1 |
| 5,816,208 | 10/1998 | Kimura | 123/182.1 |
| 5,823,153 | 10/1998 | Santi et al. | 123/182.1 |

FOREIGN PATENT DOCUMENTS

| | | | | |
|---|---|---|---|---|
| 0 362 775 | * | 4/1990 | (EP) | 123/182.1 |
| 896700 | | 2/1945 | (FR) . | |
| 607750 | | 9/1948 | (GB) . | |
| 2-67409 | | 3/1990 | (JP) . | |
| 3-107515 | | 5/1991 | (JP) . | |

* cited by examiner

*Primary Examiner*—Andrew M. Dolinar
(74) *Attorney, Agent, or Firm*—Baker & Daniels

(57) ABSTRACT

A compression release mechanism for use in a single or multi-cylinder engine to make the engine easier to hand start. The assembly includes a compression release shaft disposed substantially within the camshaft. The compression release shaft is formed in at least two segments and can therefore be formed accurately, repeatedly and cost effectively using powder metal technology. Consequently, the weight of the flyweight member that is attached to the compression release shaft can be accurately controlled, thereby allowing the compression release mechanism to disengage at a precisely known rotational velocity of the camshaft. The compression release shaft may engage one or more valve actuation devices, which in turn force exhaust valves open during starting engine speeds. The compression release mechanism is conveniently contained within the housing by a housing wall bearing against the flyweight member and a cam bearing against an end of the compression release shaft. These bearing surfaces also hold the compression release shaft segments together.

21 Claims, 10 Drawing Sheets

COMPRESSION RELEASE MECHANISM

BACKGROUND OF THE INVENTION

This invention relates to compression release mechanisms for internal combustion engines.

It is often desirable to relieve the pressure in an engine combustion chamber during starting so that it is easier for the piston to reciprocate in the engine and thus easier for the operator to manually pull the starter rope. Known compression release mechanisms lessen the pull force required to start the engine, and minimize operator fatigue during starting.

One typical compression release mechanism is disclosed in U.S. Pat. No. 3,381,676 issued May 7, 1968 to Campen. The Campen compression release mechanism includes a centrifugally-responsive flyweight, a torsional spring attached to the flyweight, and a central pin which engages a valve tappet at engine starting speeds. At higher engine speeds, the flyweight moves radially outwardly so that the pin disengages the valve tappet when the engine is running.

It is known to use a compression release mechanism for multi-cylinder engines. For example, U.S. Pat. No. 5,809,958 issued Sep. 22, 1998 to Gracyalny discloses a centrifugally-responsive flyweight to which is connected a compression release shaft disposed externally of the camshaft. The compression release shaft is connected at one end to the flyweight and extends through respective bores in two cams lobes. The release shaft includes two D-shaped cross-sectional portions which engage two respective lift members. One disadvantage of such an arrangement is that the bores for the release shaft must be drilled subsequently to heat treating the cams. Consequently, the drilling operation is more difficult, time consuming and expensive because the heat treated cams are much harder. Another disadvantage of such an arrangement is that the drilling operation is more difficult in that two separate bores must be drilled. This introduces the possibility of mislocating the bores with respect to one another. Another disadvantage of such an arrangement is that the release shaft is supported by a minimum bearing surface, viz., the two bores in the cams. Consequently, the material from which the release shaft is made must be sufficiently strong.

Japanese No. 2-67409(A) to Yoshiharu Isaka also discloses a compression release mechanism for use with multiple cylinders. A flyweight is disposed on the internal side of the cam gear and has a compression release shaft connected thereto. The compression release shaft is disposed internally of the camshaft and includes two D-shaped cross sectional portions therealong, each of which engages a separate lift member, which in turn engage separate valve tappets.

It is desirable to further reduce the cost and at the same time, simplify the assembly of a compression release mechanism.

SUMMARY OF THE INVENTION

The present invention provides a low cost, easy to assembly mechanical compression release for a single or multi-cylinder engine. Specifically, the compression release assembly of the present invention comprises a compression release shaft having at least two segments disposed substantially within a bore in the camshaft. Such an arrangement is easier to assemble and allows production from lower cost parts.

In one form thereof, the present invention provides a compression release mechanism for relieving compression during engine starting in an internal combustion engine having a camshaft rotatably disposed within a housing. The mechanism comprises a compression release shaft disposed substantially within the camshaft and comprising first and second compression release shaft segments. A flyweight member is connected to the compression release shaft. A lift member is reciprocably disposed in the camshaft. The lift member engages the compression release shaft so that the lift member extends outwardly from the camshaft and is adapted to engage a valve actuation device.

In a preferred form, the inventive compression release mechanism includes the first and second compression release shaft segments being axially non-interlocking and rotationally interlocking. In other words, rotation of one of the segments necessarily produces rotation of the other segment therewith. However, the connection between the two separate segments are not held together axially where they interface within the bore in the camshaft. Instead, one end of the release shaft is engaged by a side surface of a cam whereas the housing engages the flyweight member which is connected to the other shaft segment. It is thus the bearing surfaces of the housing and the cam that hold the two segments together within the bore.

In another preferred embodiment, the first compression release shaft segment is integrally formed with the flyweight member, both of which are manufactured using powder metal technology.

One advantage of the present invention is that the bore in the camshaft which contains the compression release shaft can be drilled in a simple one step drilling operation without interruption. By contrast, certain prior art devices require drilling through a first cam lobe and then a second cam lobe. This multiple step prior art drilling operation results in burrs on the outside of the cam surface that have to be smoothed and also introduces the possibility that the drill point becomes mislocated after it exits the first cam lobe and enters the second cam lobe.

Another advantage of the present invention is that the bore for the compression release shaft is disposed sufficiently within the surface of the camshaft so that the cams can be heat treated after drilling the compression release shaft bore in the camshaft. Advantageously, the camshaft metal is softer and therefore easier to drill prior to the heat treating.

Another advantage of the present invention is that the compression release shaft and/or the flyweight member can be formed using powder metal technology. By making the flyweight member from a metal powder, its weight can be adjusted by infiltrating copper or other dense metal into the pressed powder, which in turn allows the speed at which the compression release mechanism disengages to be finely tuned. Furthermore, expensive stamping and machining is avoided. Further still, the process of forming the parts from powder metal is reliable and consistently repeatable.

Still another advantage of the present invention is that no fasteners are needed to hold the two segments of the compression release shaft together. Yet, because the compression release shaft is disposed within the camshaft, a large bearing surface is provided therefor so that the two segments rotationally interlock one another without being fastened together. Such an arrangement would not be possible with the compression release shaft disposed externally of the camshaft as in prior art configurations.

Yet another advantage of the present invention is that the compression release shaft formed of separate segments is easier to install as part of the engine assembly process.

Yet another advantage of the present invention is that a two-piece compression release shaft can be made more cost effectively. Further advantageously, one of the compression release shaft segments can be formed integral with the flyweight member using powder metal technology.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one exemplary embodiment of the invention, in one form, and such exemplification is not to be construed as limiting the scope of the invention in any manner.

DETAILED DESCRIPTION OF THE INVENTION

Figure 1:
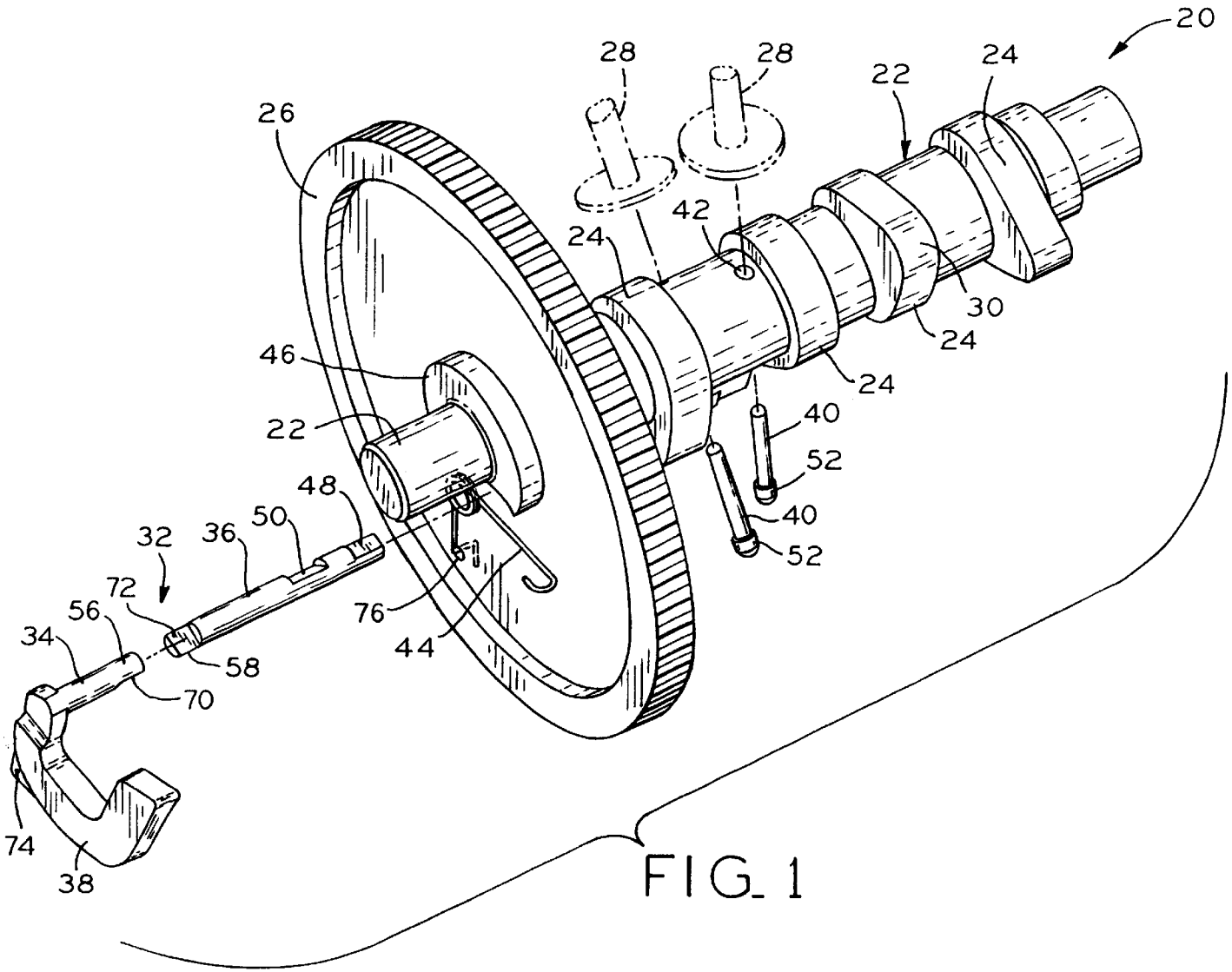
FIG. 1 is an exploded perspective view of the compression release assembly of an embodiment in accordance with the present invention.

Referring to FIG. 1, compression release assembly 20 includes camshaft 22 having cams 24 thereon as is known in the art. Cam gear 26 which engages a gear of the crankshaft (not shown) is attached to camshaft 22. Valve tappets 28 are shown in phantom and are vertically displaced by cam lobes 30 as camshaft 22 rotates at normal operating speeds.

With further reference to FIG. 1, the compression release includes compression release shaft 32 which is further comprised of two segments disposed end to end, first segment 34 and second segment 36. A centrifugally responsive flyweight member 38 is connected to compression release shaft 32. First segment 34 and flyweight member 38 are integrally formed from a powder metal using powder metal technology that is known in the art. Advantageously, powder metal technology allows fine adjustments in the weight of flyweight member 38, which in turn allows fine adjustments in the speed at which the compression release mechanism of the present invention disengages. The weight adjustments are accomplished by varying the amounts of copper in the powder mix before flyweight member 38 and first segment 34 are integrally formed.

Figure 3:
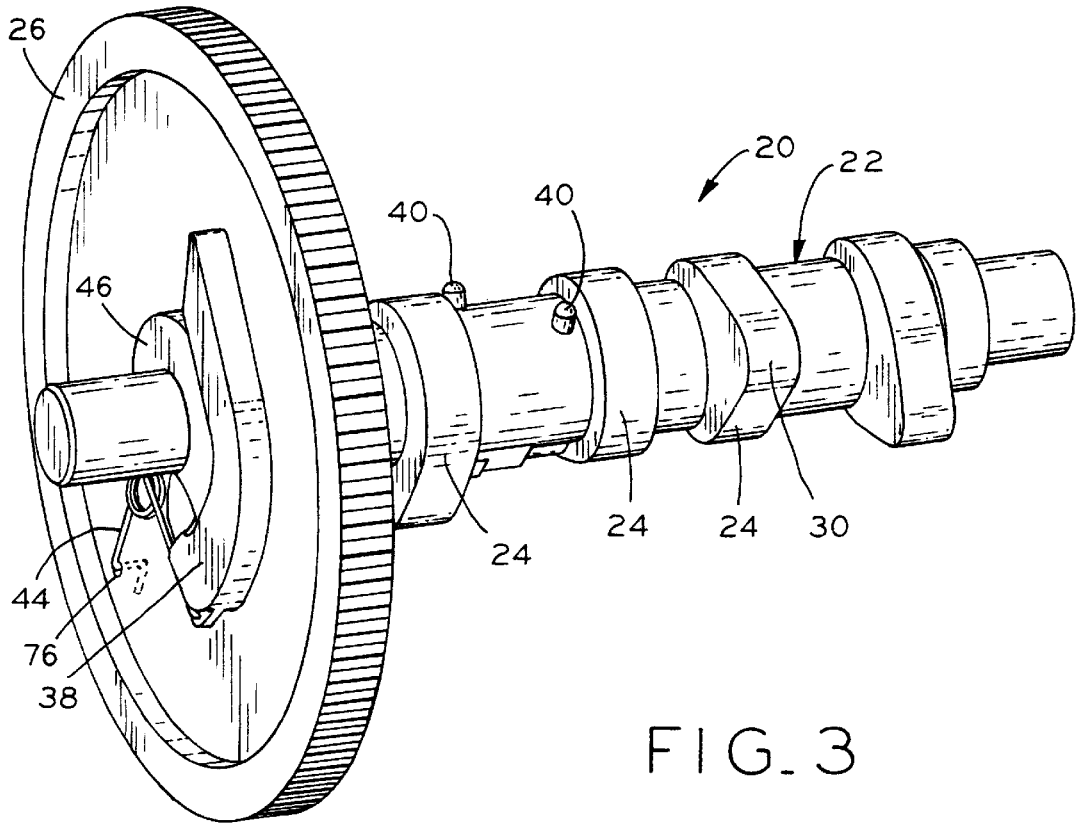
FIG. 3 is a perspective view of the compression release assembly of an embodiment in accordance with the present invention depicting slow speed start-up conditions of an engine wherein the lift members are extended.

Lift members 40, in the shape of plungers, are reciprocably disposed in holes 42 in camshaft 22. Torsional spring 44 attaches to cam gear 26 and biases flyweight member 38 to the position shown in FIG. 3. Support collar 46 supports flyweight member 38 in its most inward position as shown in FIG. 3.

Figure 1A:
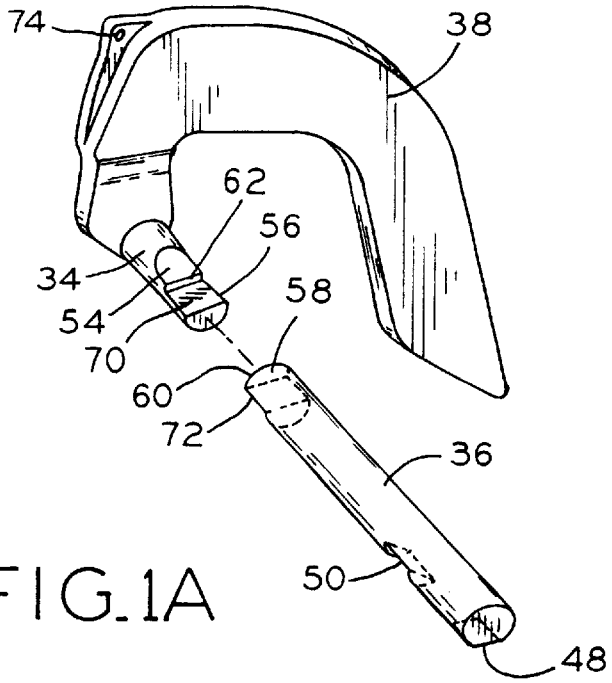
FIG. 1A is an exploded perspective view of an embodiment of the present invention showing the two-piece compression release shaft and yoke.
Figure 1B:
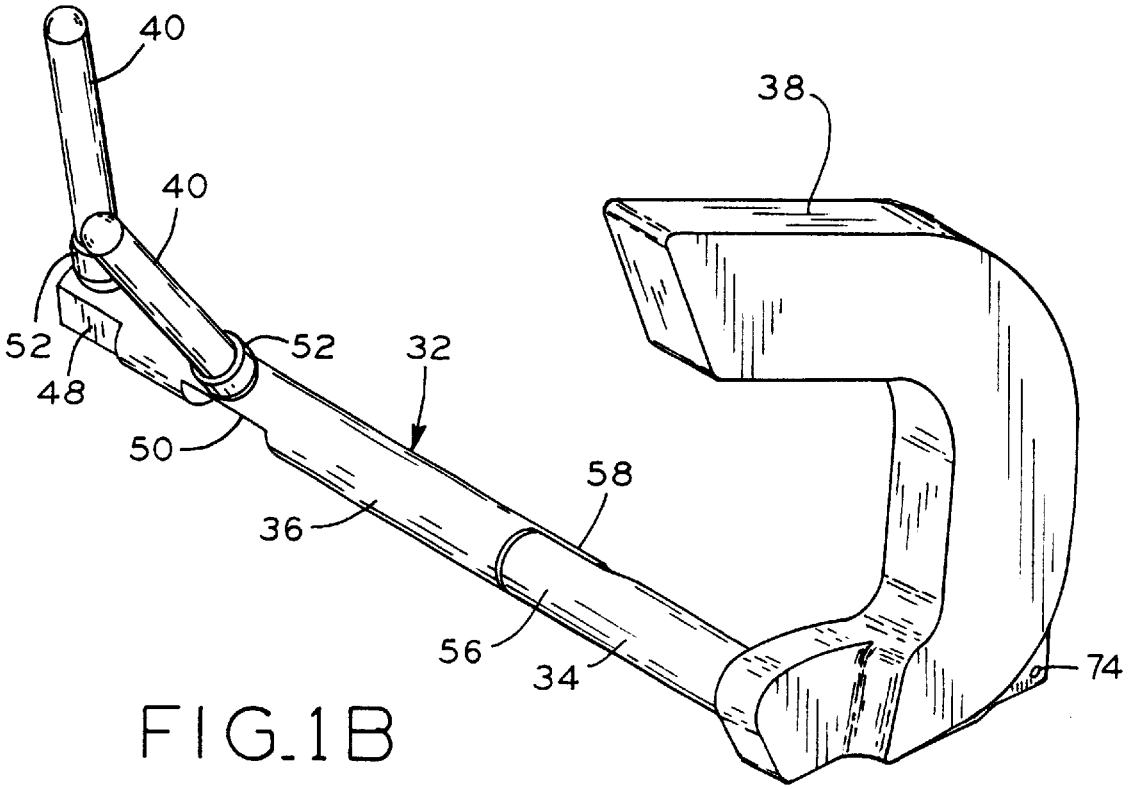
FIG. 1B is a perspective view of an embodiment in accordance with the present invention depicting the compression release shaft, yoke and lift members.
Figure 8:
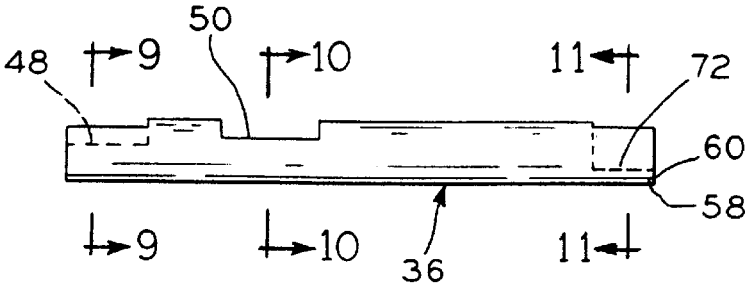
FIG. 8 is a plan view of a sub-part of the compression release shaft.
Figure 9:
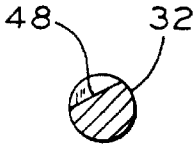
FIG. 9 is a cross sectional view taken along line 9—9 of FIG. 8.
Figure 10:
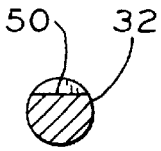
FIG. 10 is a cross sectional view taken along line 10—10 of FIG. 8.

With reference to FIGS. 1A and 1B, the structural details of the compression release shaft 32 and flyweight member 38 of the illustrated embodiment can be better appreciated. Flyweight member 38 is shaped in a boomerang configuration so that when the camshaft rotates above a minimum speed, flyweight member 38 is biased outwardly and shaft 32 rotates therewith. With reference to FIG. 1B, second segment 36 includes flat surfaces 48 and 50 thereon which operably engage lift members 40. With reference to FIGS. 8–10, it can be seen that compression release shaft 32 comprises a D-shaped cross section in areas of flat surfaces 48 and 50. As also shown with respect to FIGS. 9 and 10, flat surfaces 48 and 50 are angularly offset relative to one another. Such is particularly adaptable to the two cylinders of a V-twin engine. However, the orientation of flat surfaces 48 and 50, and accordingly, lift members 40 could be modified for a different engine configuration. It can thus be appreciated that, as shaft 32 rotates, it engages bulbous portions 52 of lift members 40 at flat surfaces 48 and 50, thereby allowing lift members 40 to disengage the respective exhaust valve tappets.

Figure 5:
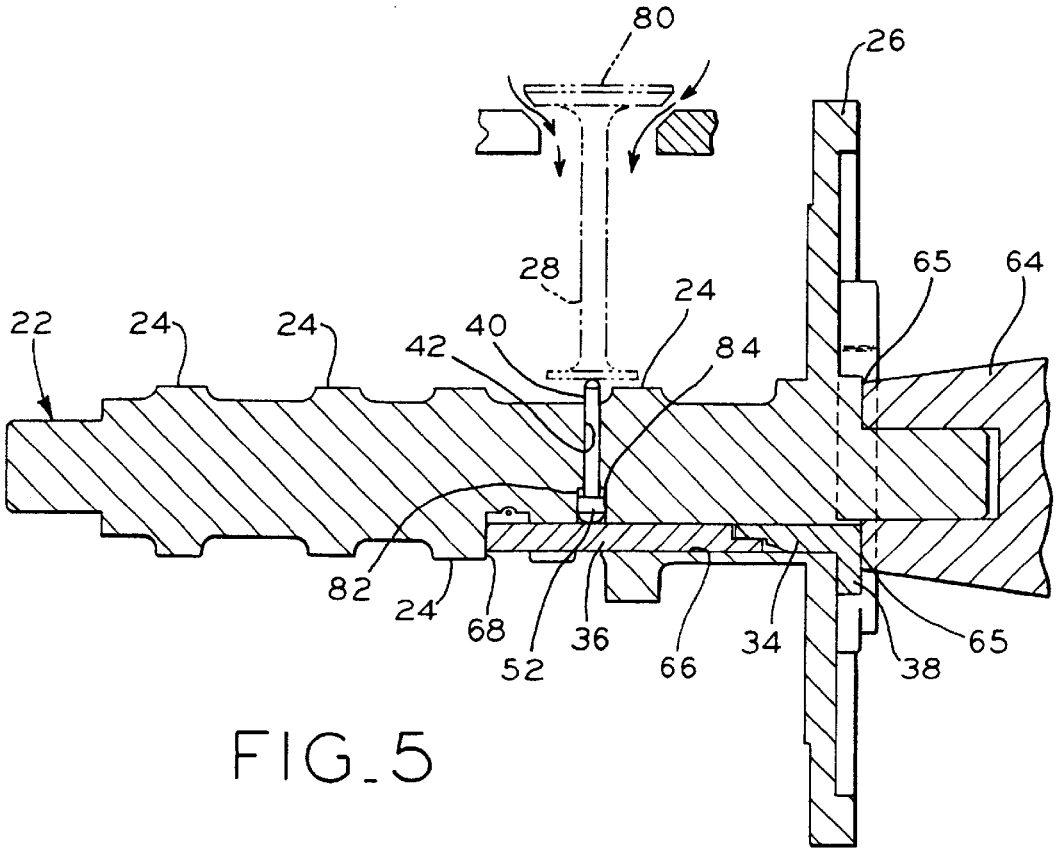
FIG. 5 is a cross sectional view taken along lines 5—5 of FIG. 4.
Figure 11:
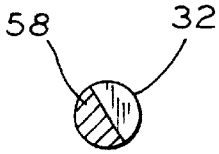
FIG. 11 is a cross sectional view taken along line 11—11 of FIG. 8.

With reference to FIG. 1A, the "rotationally interlocking" and "axially non-interlocking" features of the respective segments of shaft 32 can be appreciated. First segment 34 includes scalloped portion 54 and tongue 56 having a substantially semicircular cross sectional shape. Similarly, second segment 36 includes tongue 58 which also has a substantially semi-circular cross section as shown in FIG. 1A and in more detail in FIG. 11. Tongue 58 includes flat end 60 which abuts against flat portion 62 of first segment 34. In assembled form, the forces holding segments 34 and 36 of shaft 32 together are supplied at the ends of shaft 32. As can be seen in FIG. 5, bearing surface 65 of camshaft housing 64 abuts against a portion of flyweight member 38 proximate to the integral connection of flyweight member 38 and first segment 34, thereby maintaining shaft 32 within shaft bore 66. Side surface 68 of cam 24 abuts against and provides a bearing surface for the other end of shaft 32 thereby securing it within bore 66.

It can now be appreciated that segments 34 and 36 of compression shaft 32 are axially non-interlocking. That is, the mating surfaces of segments 34 and 36 are held together axially by forces exerted on each end of shaft 32, namely, by side surface 68 and bearing surface 65 of camshaft housing 64. Thus, "axially non-interlocking" for purposes of this specification means that the connection between segments 34 and 36 need not include fasteners, welding, epoxy or the like. Instead, if the force provided by either side surface 68 or camshaft housing 64 were removed, compression release shaft 32 would be free to separate axially into segments 34 and 36.

On the other hand, segments 34 and 36 are "rotationally interlocking." That is, when one of the segments rotates within bore 66, the other segment rotates therewith. This rotationally interlocking feature of segments 34 and 36 comprising shaft 32 in the illustrated embodiment is possible because shaft 32 is disposed internally in bore 66 within camshaft 22. Consequently, shaft 32 is surrounded by a large bearing surface provided by bore 66, which in turn maintains the mating engagement between flat surfaces 70 and 72 of tongues 56 and 58, respectively (FIG. 1A). Thus, rotational movement can be effectively communicated from segment 34 to segment 36. In general, the rotationally interlocked segments comprise each of segments 34 and 36 including tongue portions 56 and 58 extending therefrom, respectively. The tongue portions have corresponding shapes which interfit with one another. In the illustrated embodiment, the corresponding shapes include flat surfaces 70 and 72 and end 60 and flat portion 62. However, it is to be understood that one of ordinary skill in the art would be able to substitute other tongue configurations, tongue and groove configurations, etc. which interfit with one another.

The particulars of how the compression release mechanism fits within housing 64 can be understood with references to the order in which the respective parts are assembled. Lift members 40 are first placed within holes 42. Segment 36 is then inserted into bore 66. Next, segment 34 having flyweight member 38 integrally formed therewith is inserted into bore 66 in such an orientation so that flat surfaces 70 and 72 of tongues 56 and 58, respectively, rotationally interlock as shown in FIG. 1B. Thus, compression release shaft 32 extends from flyweight member 38 through cam gear 26 and further extends into bore 66. Camshaft 22 can then be installed into housing 64. As shown in FIG. 5, housing member 64 provides bearing surface 65 which abuts against cam gear 26 and flyweight member 38. Thus, compression release shaft 32 and flyweight member 38 are contained by bearing surface 65 of housing 64 and side surface 68 of a cam 24. Thus, surfaces 65 and 68 prevent segments 34 and 36 from separating. It can also be appreciated that flyweight member 38 is captured between cam gear 26 and housing 64, thereby eliminating the need for other parts to secure flyweight member 38 to cam gear 26.

Figure 4:
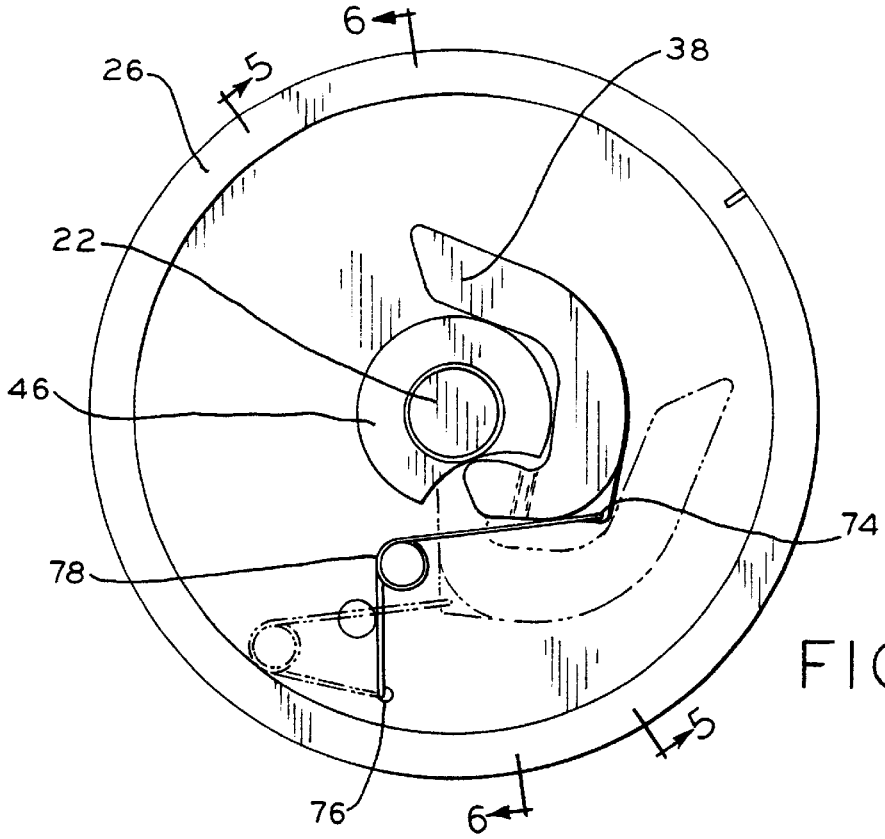
FIG. 4 is a side elevational view of the assembly shown in FIG. 3.

The remaining structural details of the compression release assembly of the illustrated embodiment can be better understood with reference to a description of operation. At start-up operating speeds, such as when an operator is manually pulling on a starter rope (not shown), camshaft 22 is moving at a low rate of speed. During such low rates of camshaft speed, torsional spring 44 biases flyweight member 38 to the position shown in FIGS. 3 and 4. As can be seen in FIG. 4, torsional spring 44 has one of its ends inserted in hole 74 of flyweight member 38, whereas the other end of spring 44 is inserted in hole 76 of cam gear 26. Coil 78 of spring 44 pivots freely as flyweight member 38 moves outwardly as shown in phantom lines in FIG. 4. As shown in FIG. 5, at low camshaft rotational speeds, lift member 40 is fully extended and engages a valve actuation device such as valve tappets 28 such that exhaust valves 80 are open, thereby allowing the gases to escape from the cylinder, which in turn results in the starter cord providing less resistance to being pulled. While the valve actuation devices in the illustrated embodiment are shown as valve tappets 28, it is to be understood that the principles embodied by the present invention can be applied to engage other valve actuation devices, depending upon the type of engine in which the present invention is employed. Other valve actuation devices include push rods, rocker arms, valves and the like.

Figure 2:
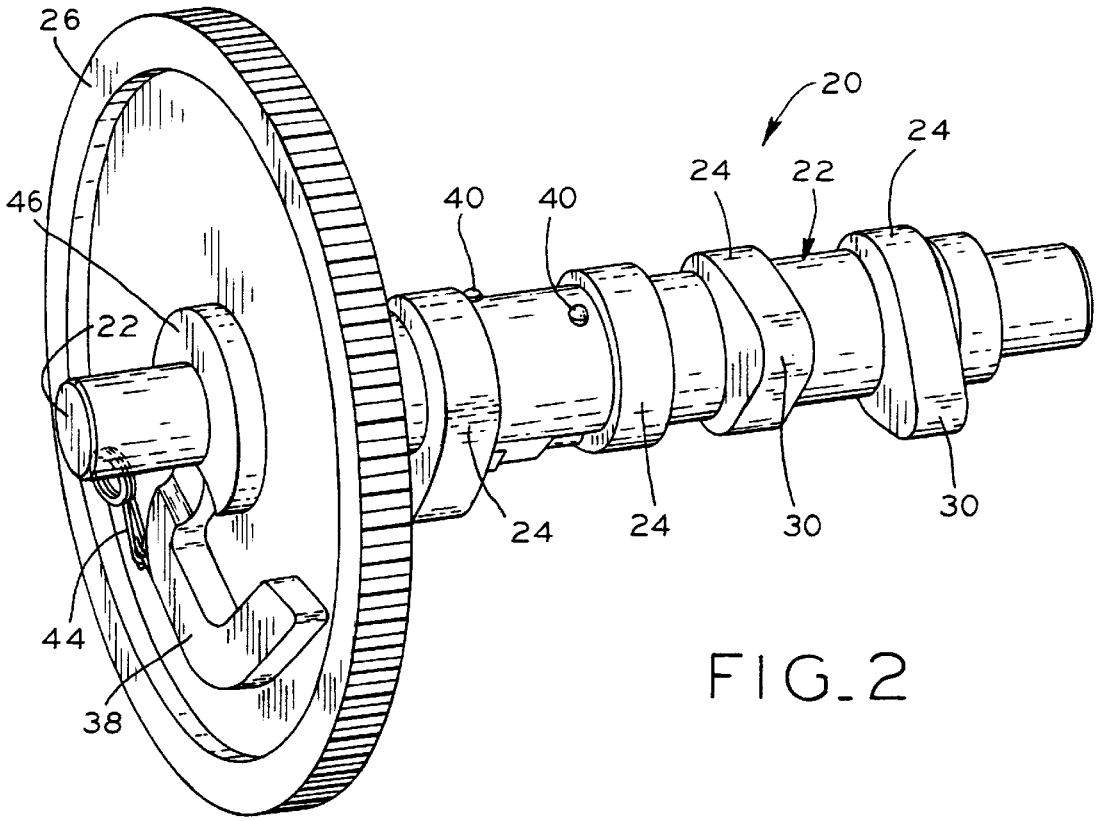
FIG. 2 is a perspective view of the compression release assembly of an embodiment of the present invention shown at engine operating speeds wherein the lift members are disengaged.

Upon camshaft 22 obtaining a minimum rotational speed, flyweight member 38 is centrifugally biased outwardly toward the position shown in FIG. 2 and in phantom in FIG. 4. As noted above, the camshaft rotational speed at which flyweight member 38 begins to move outwardly can be pre-determined by adjusting the weight of flyweight member 38 utilizing powder metal technology.

Figure 6:
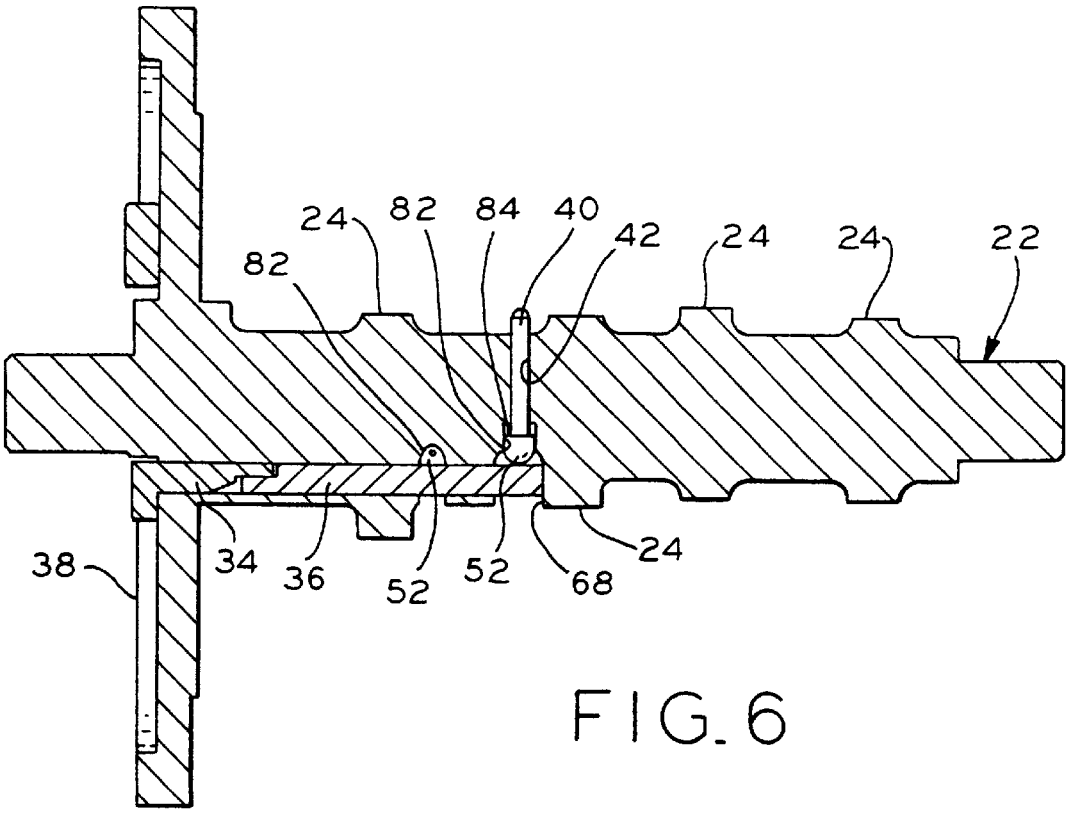
FIG. 6 is a cross sectional view taken along lines 6—6 of FIG. 4.
Figure 7:
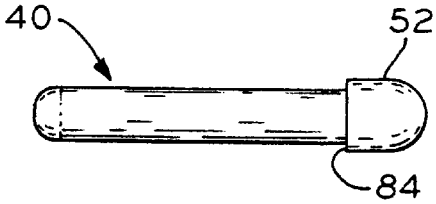
FIG. 7 is a side elevational view of a lift member in accordance with the illustrated embodiment.

As shown in FIGS. 2 and 4, as the rotational speed of the camshaft reaches a minimum value, flyweight member 38 is biased outwardly, and as a result, lift members 40 retract inwardly and disengage from the valve tappets. As a result, cams 24 control the opening and closing of the exhaust valves, the mechanism by which being widely known in the art. The lift members are biased inwardly into enlarged portion 82 (FIGS. 5 and 6) of holes 42 by the centrifugal force on bulbous portion 52 from the rotation of camshaft 22. Thus, when shaft 32 rotates from the position shown in FIGS. 1B and 5 to a position wherein surfaces 48 and 50 engage bulbous ends 52, lift members 40 retract inwardly into camshaft 22 so that cams 24 thereafter operate the opening and closing of the valves (not shown).

FIGS. 12–22 show a second embodiment of the present invention. The embodiments are similar in overall concept and function with the reference numbers for similar elements increased by 100 for the second embodiment, i.e., camshaft 22 in FIGS. 1–11 is camshaft 122 in FIGS. 12–22. Major differences between the second embodiment and the discussion above involve the spring, the location of one of the flat surfaces on the compression release shaft, and the size of the bulbous portion of the lift member.

Figure 12:
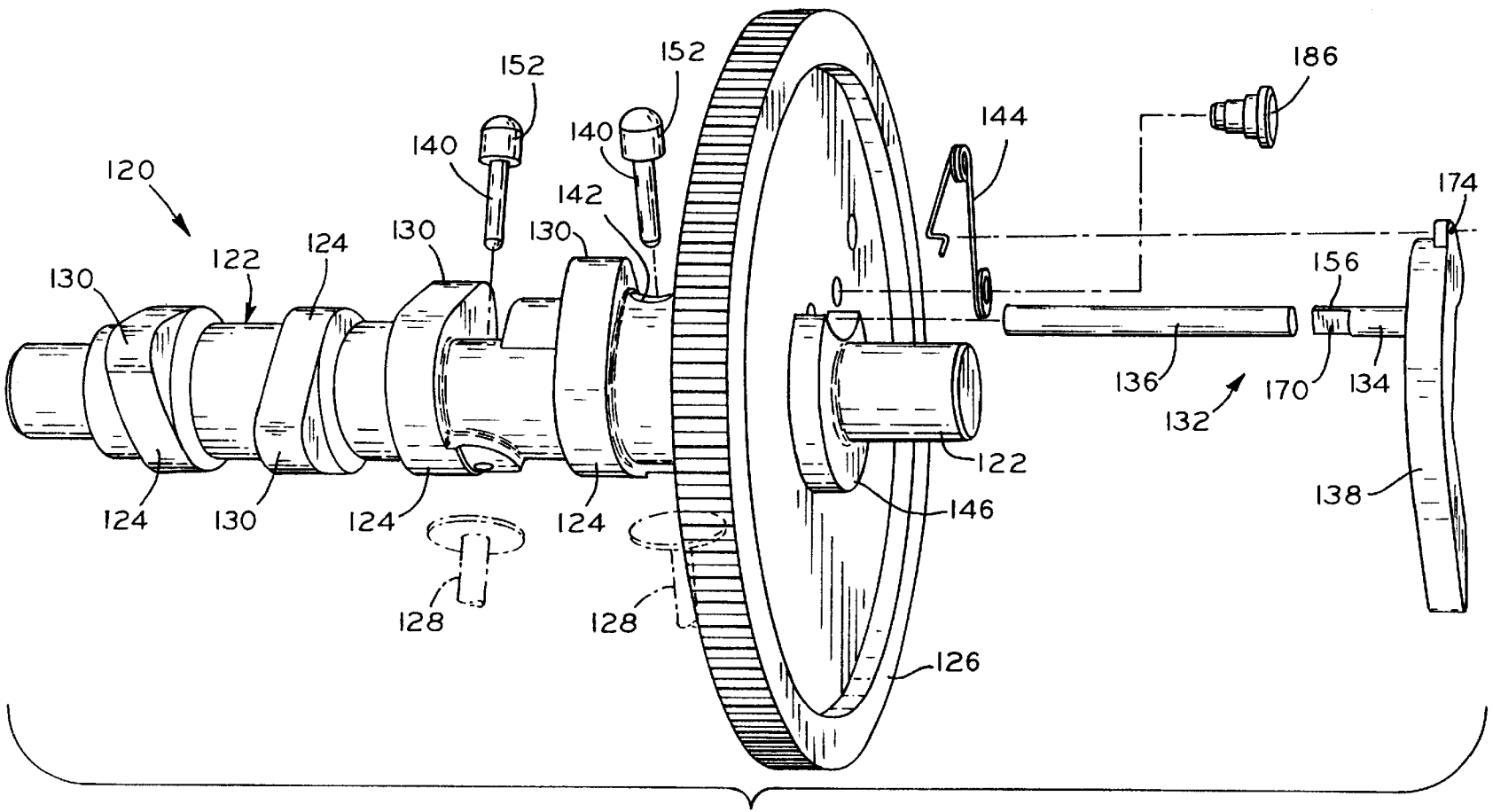
FIG. 12 is an exploded perspective view of the compression release assembly of a second embodiment in accordance with the present invention.
Figure 15:
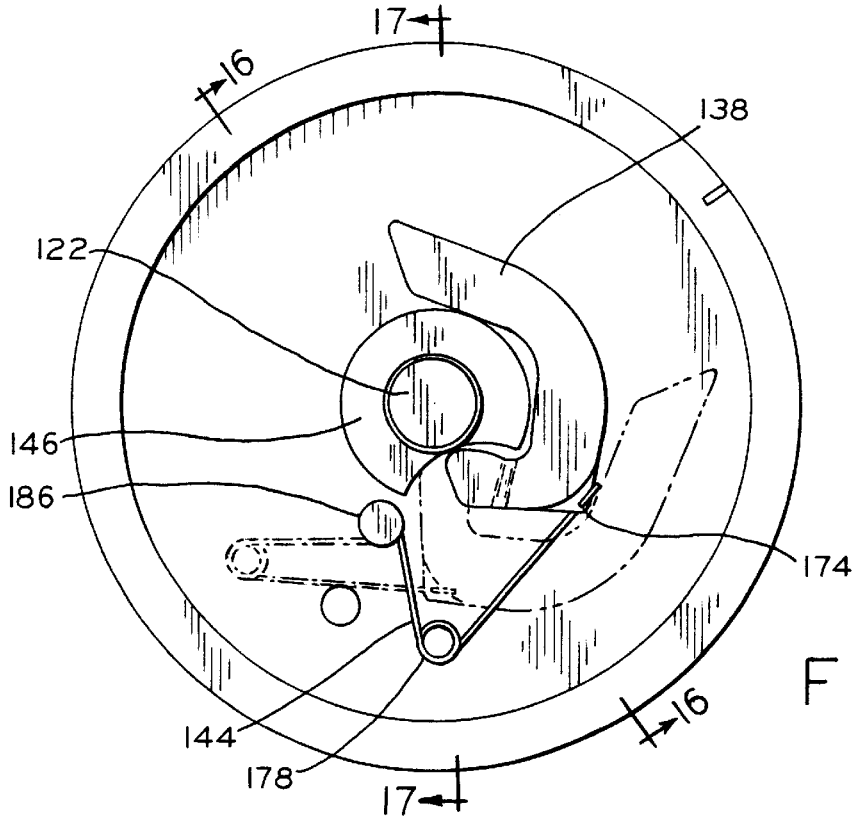
FIG. 15 is a side elevational view of the assembly shown in FIG. 14.
Figure 16:
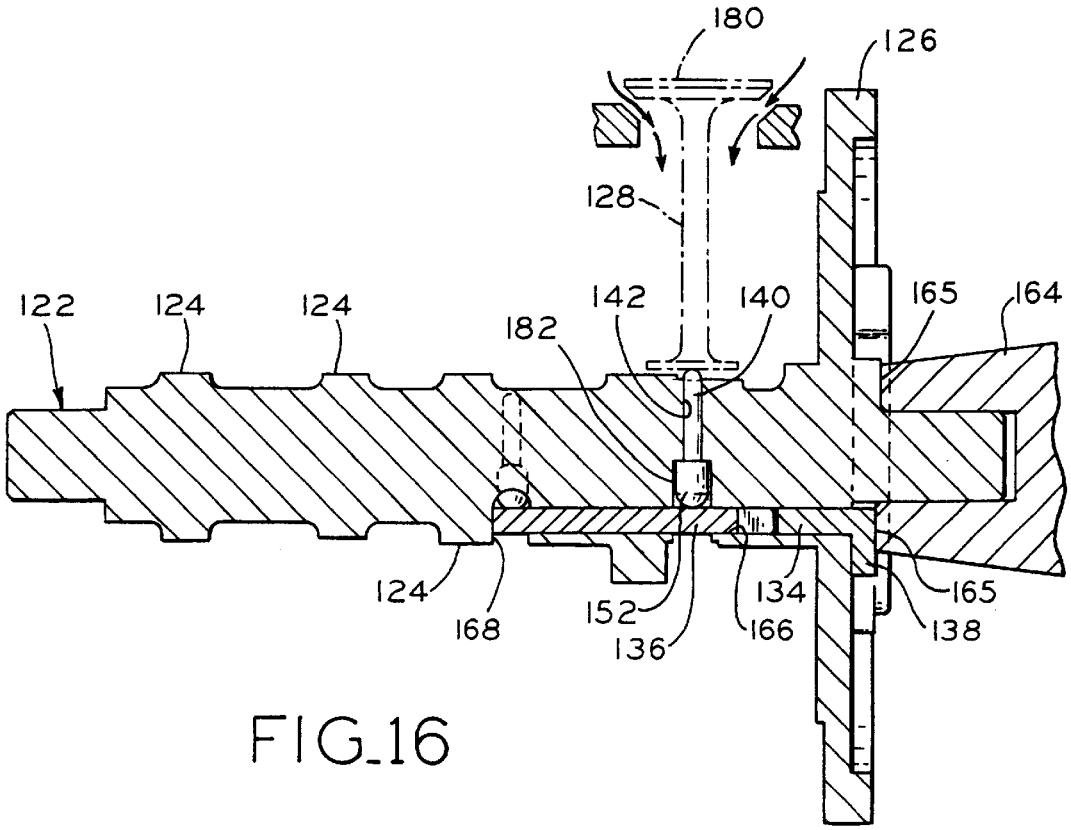
FIG. 16 is a cross sectional view taken along lines 16—16 of FIG. 15.
Figure 17:
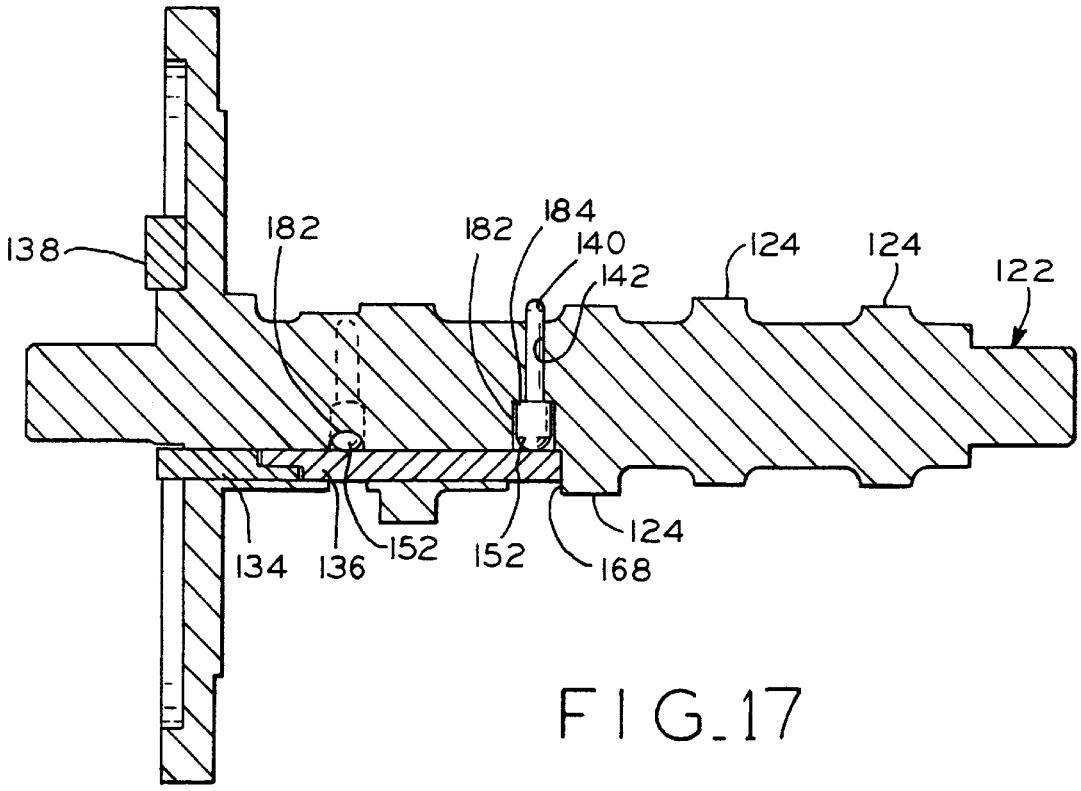
FIG. 17 is a cross sectional view taken along lines 17—17 of FIG. 15.

As shown in FIGS. 12 and 15 an end of torsional spring 144 is attached to cam gear 126 with rivet 186, whereas in the first embodiment that end of torsional spring 44 is inserted in hole 74 of cam gear 26. The end of spring 144 has a loop that goes around pressed in rivet 186.

Figure 12A:
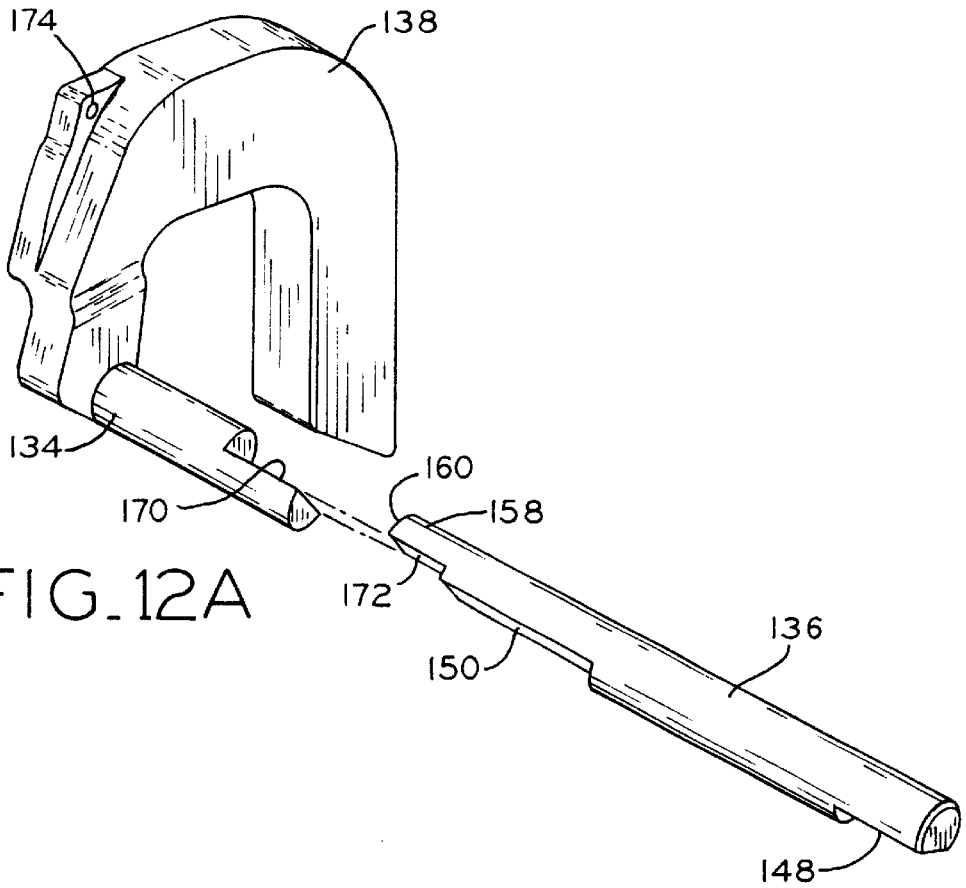
FIG. 12A is an exploded perspective view of the second embodiment of the present invention showing the two-piece compression release shaft and yoke.
Figure 12B:
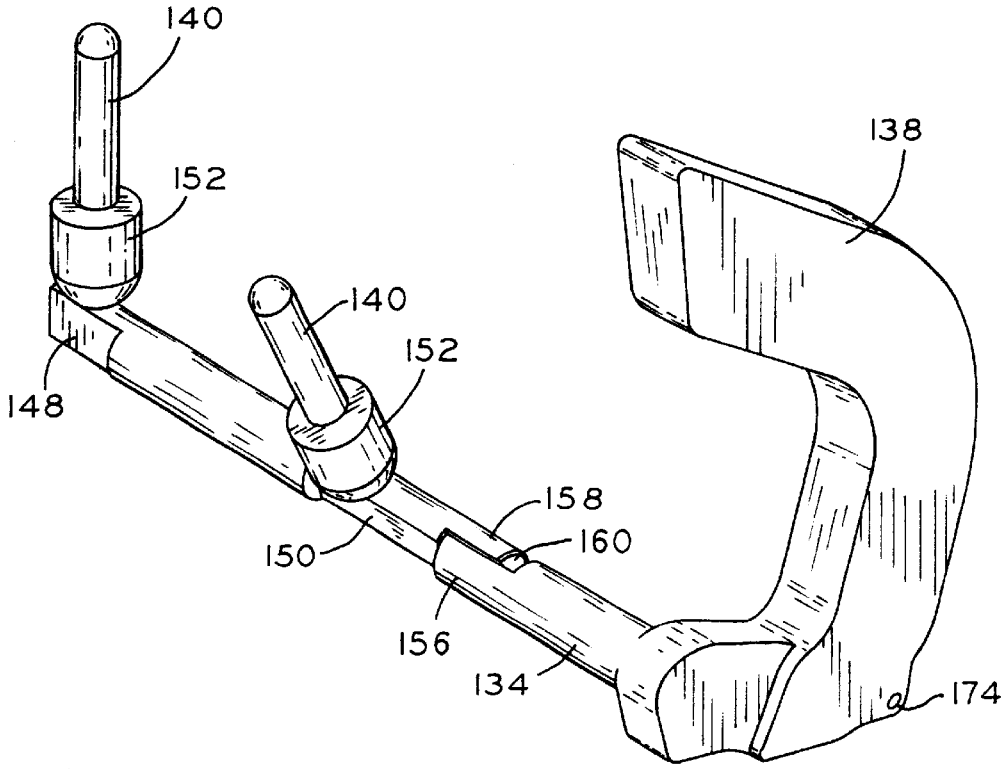
FIG. 12B is a perspective view of the second embodiment in accordance with the present invention depicting the compression release shaft, yoke and lift members.
Figure 13:
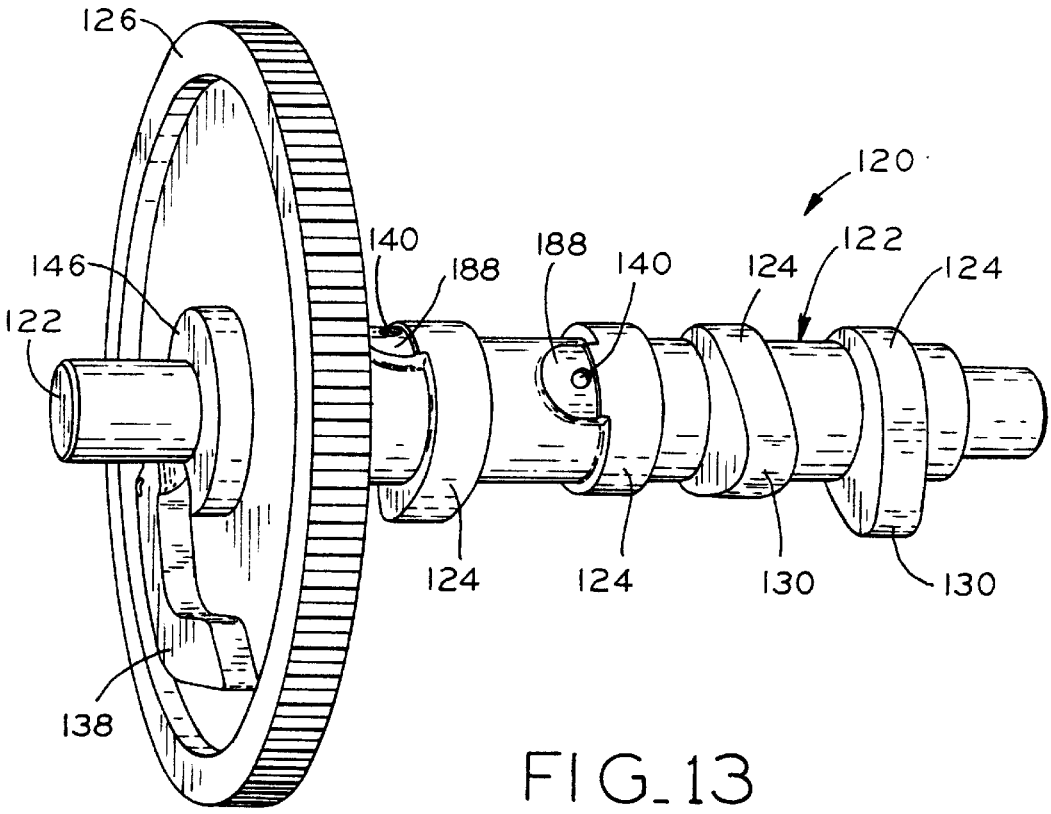
FIG. 13 is a perspective view of the compression release assembly of the second embodiment of the present invention shown at engine operating speeds wherein the lift members are disengaged.
Figure 14:
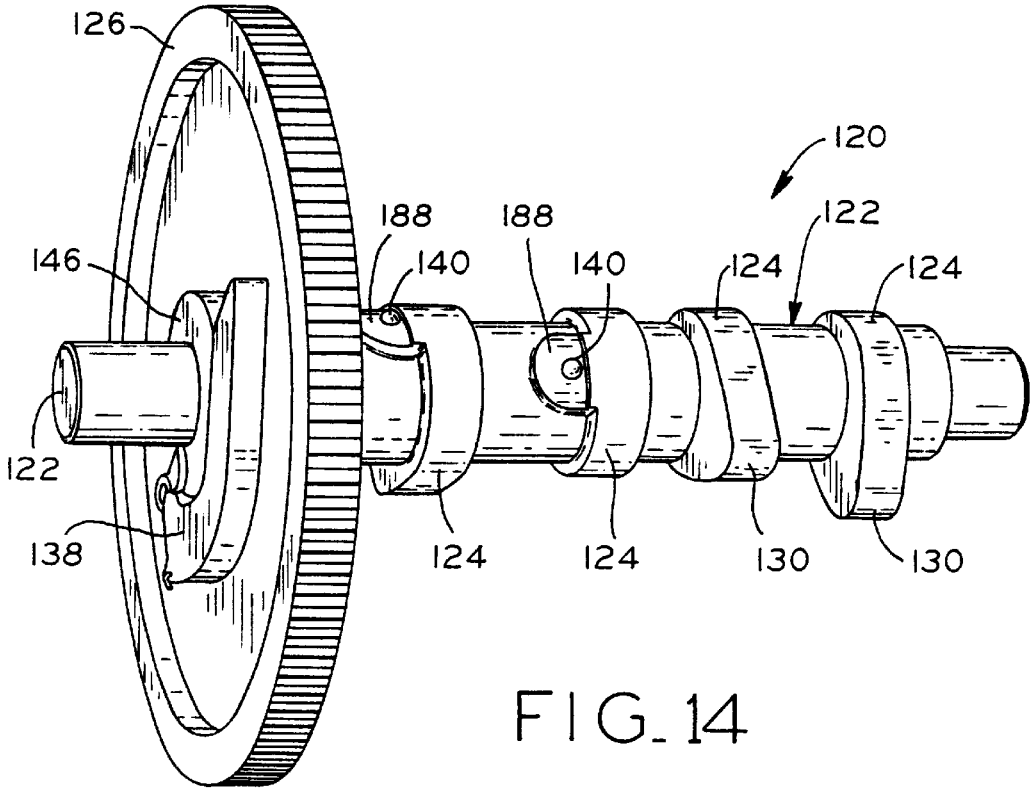
FIG. 14 is a perspective view of the compression release assembly of the second embodiment in accordance with the present invention depicting slow speed start-up conditions of an engine wherein the lift members are extended.

Referring to FIGS. 12A and 12B, flat surface 150 on second segment 136 of compression release shaft 132 is disposed adjacent tongue 158 providing maximum separation between flat surfaces 148 and 150. The separation between flat surfaces 148 and 150 is dependent on the separation between lift members 140. The increased separation between the lift members is due to the moving of the lift member nearest the cam gear to the other side of its cam as shown in FIGS. 13 and 14. Also this embodiment includes support bosses 188 in the area of the camshaft around the two lift members.

Figure 18:
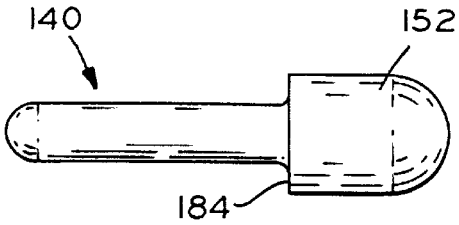
FIG. 18 is a side elevational view of a lift member in accordance with the second embodiment.
Figure 19:
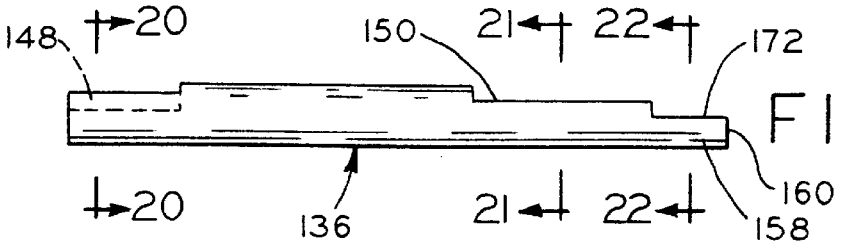
FIG. 19 is a plan view of a sub-part of the compression release shaft.
Figure 20:
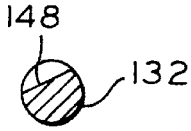
FIG. 20 is a cross sectional view taken along line 20—20 of FIG. 19.
Figure 21:
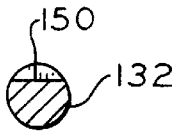
FIG. 21 is a cross sectional view taken along line 21—21 of FIG. 19.
Figure 22:
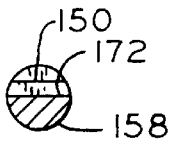
FIG. 22 is a cross sectional view taken along line 22—22 of FIG. 19.

Referring now to FIG. 18, the size of bulbous portion 152 of lift member 140 has increased over the size of bulbous portion 52 of lift member 40. The centrifugal force on the enlarged bulbous portion is greater than on its smaller counterpart. The center of gravity of the lift member is on the bulbous side of the lift member such that when the camshaft is turning and the flyweight is opened, the centrifugal force on the center of gravity of the lift member causes the lift member to retract into the camshaft and not make contact with the valve tappet. Without a sizable bulbous on the lift member, the lift member would not retract and would make contact with the valve tappet at engine operating speed causing a wear failure between the valve tappet and the lift member.

While an exemplary embodiment of this invention has been described, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A compression release mechanism for relieving compression during engine starting in an internal combustion engine having a camshaft rotatably disposed within a housing, the camshaft having cams and a cam gear disposed thereon, said mechanism comprising:

the camshaft defining a bore therein;

a compression release shaft disposed within said bore and comprising first and second compression release shaft segments having abutting mating surfaces against which the first and second compression release shaft segments are disposed end to end;

a flyweight member connected to said compression release shaft; and a lift member reciprocably disposed in the camshaft, said lift member engaging said compression release shaft, said lift member extending outwardly from said camshaft and being adapted to engage a valve actuation device when said compression release shaft is rotated.

2. The compression release mechanism of claim 1, wherein said first and said second compression release shaft segments are axially non-interlocked and rotationally interlocked.

3. The compression release mechanism of claim 2, wherein:

each of said first and second segments include a tongue portion extending therefrom; and said tongue portions have corresponding shapes which interfit with one another.

4. The compression release mechanism of claim 1, wherein said first compression release shaft segment is integrally formed with said flyweight member.

5. The compression release shaft of claim 4, wherein said flyweight member is formed from a powder metal.

6. The compression release mechanism of claim 1, wherein one of said first and said second segments is formed from a powder metal.

7. The compression release mechanism of claim 1, comprising a second said lift member, each said lift member engaging said compression release shaft.

8. The compression release mechanism of claim 1, wherein said camshaft is connected to and driven by the cam gear and said flyweight is captured between the cam gear and a wall of the housing.

9. The compression release mechanism of claim 8, wherein:

said first compression release shaft segment extends through the cam gear and is integrally formed with said flyweight; and an end of said second compression release shaft segment abuts against one of the cams;

whereby, the wall of the housing and the one cam provide bearing surfaces which hold said first and said second segments together.

10. A compression release mechanism for relieving compression during engine starting in a multi-cylinder internal combustion engine including a camshaft having cams and a cam gear disposed thereon, the camshaft rotatably disposed within a housing, said mechanism comprising:

at least two lift members reciprocably disposed in the camshaft, said lift members adapted to engage valve actuation devices;

a flyweight member captured between the cam gear and the housing, the housing providing a bearing surface for said flyweight member;

a spring element provided on a side of the cam gear which faces the housing, the spring element biasing the flyweight member; and a compression release shaft connected to said flyweight member, said compression release shaft extending through the cam gear and further extending into a bore in the camshaft, said compression release shaft engaging said at least two lift members, wherein an end of said compression release shaft bearingly abuts against one of the cams, whereby the bearing surface of the housing and the cam axially retain said flyweight and said compression release shaft.

11. The compression release mechanism of claim 10, wherein said compression release shaft is disposed substantially within the camshaft.

12. The compression release mechanism of claim 10, wherein said compression release shaft comprises first and second compression release shaft segments, said segments being axially non-interlocked and rotationally interlocked, whereby the bearing surface of the housing and the cam prevent said two segments from separating.

13. The compression release mechanism of claim 10, wherein said compression release shaft comprises first and second compression release shaft segments disposed in said bore.

14. The compression release mechanism of claim 12, wherein one of said first and second release shaft segments is integrally formed with said flyweight member, said flyweight member being formed from a powder metal.

15. The compression release mechanism of claim 10, wherein each of said lift members includes a bulbous portion.

16. A compression release mechanism for relieving compression during engine starting in an internal combustion engine having a camshaft rotatably disposed within a housing, the camshaft having cams and a cam gear disposed thereon, said mechanism comprising:

a compression release shaft;

a flyweight member integrally formed with a portion of said shaft whereby the flyweight member and the portion of the shaft comprise a continuous unitary structure; and a lift member reciprocably disposed in the camshaft, said lift member engaging said compression release shaft, said lift member extending outwardly from said camshaft and being adapted to engage a valve actuation device when said compression release shaft is rotated, wherein said first and said second compression release shaft segments are axially non-interlocked and rotationally interlocked.

17. The compression release mechanism of claim 16, wherein:

each of said first and second segments include a tongue portion extending therefrom; and said tongue portions have corresponding shapes which interfit with one another.

18. The compression release mechanism of claim 16, wherein:

said camshaft is connected to and driven by the cam gear and said flyweight is captured between the cam gear and a wall of the housing;

said first compression release shaft segment extends through the cam gear; and an end of said second compression release shaft segment abuts against one of the cams;

whereby, the wall of the housing and the one cam provide bearing surfaces which hold said first and said second segments together.

19. The compression release shaft of claim 16, wherein said flyweight member is formed from a powder metal.

20. The compression release mechanism of claim 16, comprising a second said lift member, each said lift member engaging said compression release shaft.

21. The compression release mechanism of claim 16, wherein said compression release shaft is disposed substantially within the camshaft.

* * * * *